US005844364A

United States Patent [19]

Beardmore

[11] Patent Number: 5,844,364

[45] Date of Patent: Dec. 1, 1998

[54] INCANDESCENT LIGHT-EMITTING ASSEMBLIES

[75] Inventor: Geoffrey Beardmore, Prestbury, England

[73] Assignee: Smiths Industries PLC, London, England

[21] Appl. No.: 831,852

[22] Filed: Apr. 4, 1997

[30] Foreign Application Priority Data

Apr. 16, 1996 [GB] United Kingdom ..... 9607862

[51] Int. Cl.[6] ..... H01K 1/16; H01K 1/34

[52] U.S. Cl. ..... 313/522; 313/580; 313/634; 313/27; 313/37; 313/47; 313/112; 345/73

[58] Field of Search ..... 313/522, 578, 313/579, 580, 634, 27, 25, 37, 47, 112, 115, 636, 635; 345/73

[56] References Cited

U.S. PATENT DOCUMENTS

| | | | |
|---|---|---|---|
| 3,412,277 | 11/1968 | Thouret | 313/578 |
| 3,715,785 | 2/1973 | Brown et al. | 313/109.5 |
| 3,846,661 | 11/1974 | Brown et al. | 315/68 |
| 4,006,546 | 2/1977 | Anderson et al. | 40/132 |
| 4,234,914 | 11/1980 | Boesen | 362/240 |
| 4,283,659 | 8/1981 | Beckerman et al. | 315/161 |
| 4,563,617 | 1/1986 | Davidson | 313/522 |
| 4,771,278 | 9/1988 | Pooley | 340/780 |
| 5,084,806 | 1/1992 | Nagai | 362/214 |
| 5,285,131 | 2/1994 | Muller et al. | 313/578 |
| 5,321,417 | 6/1994 | Voelzke et al. | 345/32 |
| 5,644,676 | 7/1997 | Blomberg et al. | 313/522 |

FOREIGN PATENT DOCUMENTS

| | | | |
|---|---|---|---|
| 0 125 589 | 11/1984 | European Pat. Off. | H01J 1/14 |
| 2134361 | 12/1972 | France | H05K 3/00 |
| 56-100930 | 1/1983 | Japan | H01J 31/16 |
| 980142 | 1/1965 | United Kingdom | H01K 1/00 |
| 1013127 | 12/1965 | United Kingdom | H01J 9/26 |

OTHER PUBLICATIONS

P. Alt et al., *Performance & Design Considerations of the Thin Film Tungsten Matrix Display,* IEEE Transactions on Electron Devices vol. ED–20, No. 11 pp. 1006–1015, Nov. 1973.

*Primary Examiner*—Frank G. Font
*Assistant Examiner*—Michael Day
*Attorney, Agent, or Firm*—Pollock, Vande Vande & Priddy

[57] ABSTRACT

A display has a matrix array of cells formed in a silicon plate and each containing a tungsten strip filament. The cells are filled with a halogen gas and are sealed by a double-glazed window with an infra-red reflecting filter to reflect heat back into the cell while allowing the transmission of visible radiation. The rear of the plate is treated to make it microporous and reduce its thermal conductivity.

20 Claims, 2 Drawing Sheets

INCANDESCENT LIGHT-EMITTING ASSEMBLIES

BACKGROUND OF THE INVENTION

This invention relates to light-emitting assemblies.

The invention is more particularly concerned with lighting and display assemblies including a matrix array of light sources.

Light-emitting assemblies are known in which the assembly comprises a matrix array of individual light sources. The sources may, for example, be back-lit LCD elements or gas discharge sources, such as described in WO 90/00075, GB 2244855, GB 2247563, GB 2247977, GB 2254724, GB 2261320, GB 2274191, GB 2269700, GB 2284703 and GB2254724. Where the individual sources can be separately addressed, the system can provide a display representation. These assemblies have advantages in that they can be made with a flat configuration, thereby making them particularly useful where a compact assembly is needed.

Conventional light-emitting assemblies suffer from various disadvantages, such as requiring a high voltage supply, having a limited range of color, and being sensitive to external temperature.

BRIEF SUMMARY OF THE INVENTION

It is an object of the present invention to provide an improved light-emitting assembly.

According to one aspect of the present invention there is provided a light-emitting assembly comprising a lower planar base member and an upper planar transparent window sealed with the base member to define therebetween an array of light-emitting cells, each cell including a respective filament that can be energized to incandesce and emit light.

The filaments are preferably uncoiled strips and are preferably supported at opposite ends to extend across each cell spaced above its floor. The filaments may be approximately 10 $\mu$m wide and 5 $\mu$m thick. The cells are preferably filled with a gas and the filament is preferably of a material that evaporates and combines with the filling gas at surfaces in the cell to form an unstable compound that separates back into its component parts at the filament, so as to promote deposition of evaporated material back onto the filament. The filament may be of tungsten and the cells may be filled with a halogen gas and krypton, xenon or argon. The cells preferably have side walls that slope outwardly towards their upper ends and may be formed by etching isotropically along a crystal lattice of the base member. The base member may be substantially of silicon and the cells are preferably square. The cells preferably have a floor and side walls with a light-reflecting layer thereon. The lower surface of the base member is preferably treated to make it microporous and reduce its thermal conductivity. The window may have a filter arranged to transmit visible radiation and to reflect infra-red radiation back into the cell. The assembly preferably includes two transparent windows spaced from one another, the space between the two windows being evacuated. The base member may comprise an upper and a lower plate, the filament being supported at opposite ends between the upper and lower plate. The cross-section of each filament may vary along its length in such a way as to equalize heat distribution along the length of the filament. The assembly may include an address unit connected to address individual ones of the cells. The cells may include different colored filters such that light emitted from different ones of the cells are of different colors. The assembly may include means for controlling the brightness of light emitted from the cells, the means being arranged to vary the energization of cells of different colors to compensate for color shift on dimming or brightening.

According to another aspect of the present invention there is provided a light-emitting assembly including a cell having an incandescent filament, a support for opposite ends of the filament and a window assembly extending above and sealed with said support to enclose the filament between the support and the window, the window assembly including two plates of transparent material separated from one another by an evacuated space, and a filter that transmits visible radiation but reflects infra-red radiation back into the cell.

According to a further aspect of the present invention there is provided a light-emitting assembly including a transparent cell having an incandescent filament, the cell being filled with a gas and the filament being of a material that evaporates and combines with the filling gas at surfaces in the cell to form an unstable compound that separates back into its component parts at the filament, so as to promote deposition of evaporated material back onto the filament, the filament being an uncoiled strip.

According to a fourth aspect of the present invention there is provided a method of forming a light-emitting cell including the steps of providing a conductive strip filament on a supporting surface, removing a part of the supporting surface from beneath the filament so that it is supported only at opposite ends, and encapsulating the filament.

The part of the supporting surface is preferably removed by etching.

According to a fifth aspect of the present invention there is provided a light-emitting assembly including a light-emitting cell formed by a method according to the above fourth aspect of the invention.

According to a sixth aspect of the present invention there is provided a display including a light-emitting assembly according to any one of the above one, other, further or fifth aspects of the invention.

A flat panel display assembly, in accordance with the present invention, will now be described, by way of example, with reference to the accompanying drawings.

DETAILED DESCRIPTION OF THE PREFERRED EMBODIMENT

Figure 1:
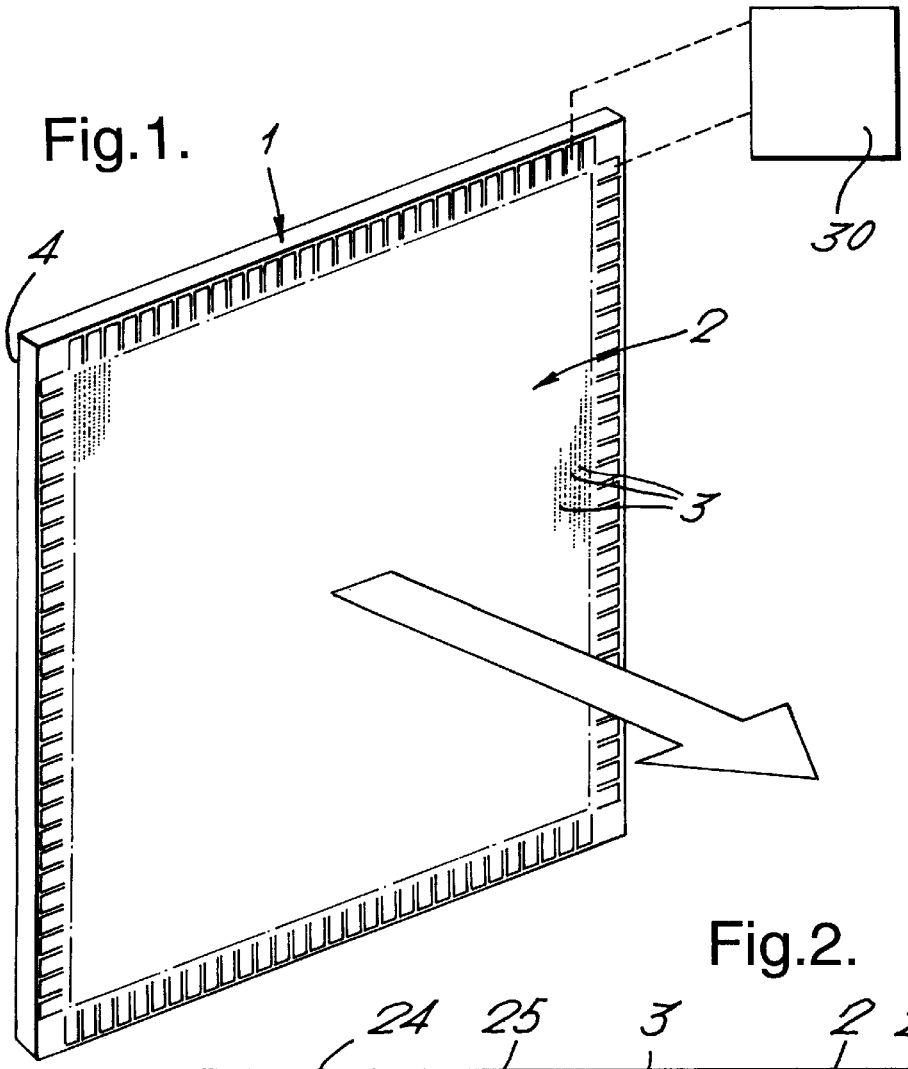
FIG. 1 is a perspective view of the assembly.
Figure 2:
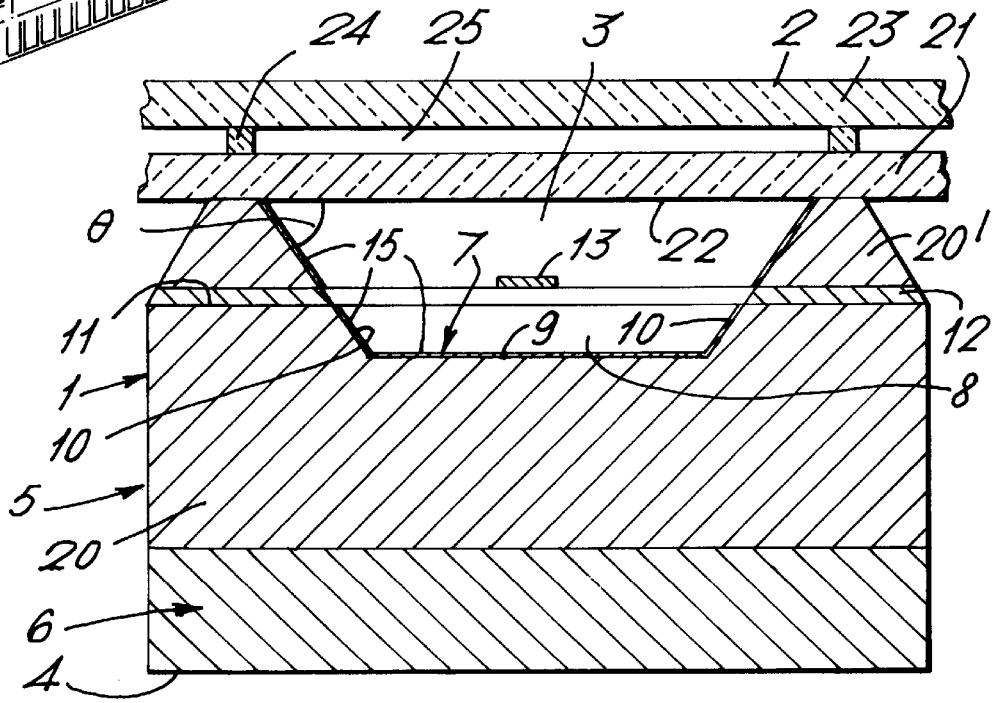
FIG. 2 is a transverse sectional elevation of a part of the assembly to a larger scale.
Figure 3:
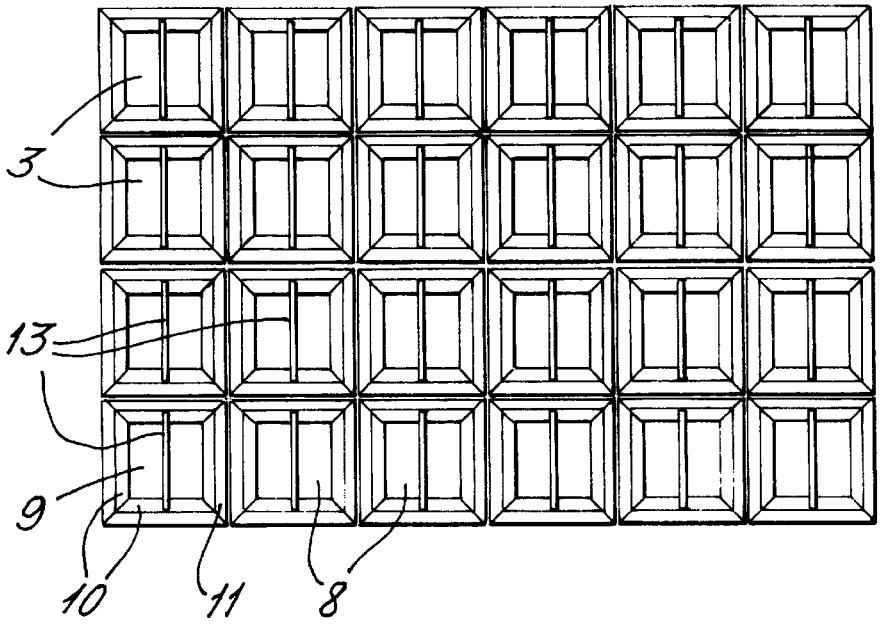
FIG. 3 is a plan view of a part of the front of the assembly.

With reference to FIGS. 1 to 3, the display assembly 1 is square with sides about 10 cm long and is about 3 mm thick, although a wide range of other shapes and sizes are possible. Light is produced from the front face 2 of the assembly from an array of 200×200 cells 3 within the assembly.

The rear face 4 of the assembly is provided by a planar base member or structure 5 having a lower silicon plate or wafer 20 and an upper silicon plate or wafer 20'. The lower surface of the lower wafer 20 is etched to form a layer 6 of microporous silicon, which acts as a thermal insulator. The upper surface 7 of the lower wafer 20 is formed with an array of square recesses 8, each having a flat floor 9 and outwardly-sloping walls 10. The upper surface 11 of the walls 10 is flat. A horizontal metal interconnect layer 12, etched away to form a pattern of conductive tracks, extends across the tops of the walls. A tungsten filament 13 extends centrally across each cell 3 and is connected at each end to respective tracks of the interconnect layer 12. Each filament 13 is a strip of rectangular section, being typically 386 ∞m long, 10 μm wide and 5 μm thick. The filaments 13 extend linearly across the cells and are not coiled. The filaments 13 in cells along the same column are aligned with one another and those in different columns are parallel to one another, as shown in FIG. 3.

The upper silicon plate or wafer 20' extends on top of the interconnect layer 12 and this is etched to form a continuation of the sloping walls 10 of the lower wafer 5. Surfaces of the lower and upper wafers 20 and 20' exposed within the cells 3 are coated with a layer 15 of reflective aluminum so that radiation is reflected upwardly. The upper wafer 20' supports an inner silica window 21, which seals each cell 3 and is spaced above the filaments 13. The filaments 13 extend approximately midway up the height of each cell 3, away from the floor 9 of the cell and the roof of the cell provided by the underside of the window 21. The silica from which the window 21 is made is transparent to both visible and infra-red radiation. In order to reduce the loss of infra-red radiation from the cells 3, the underside of the window 21 has a dichroic filter layer 22, such as a multi-layer interference film about 0.1 μm thick, which is tuned to transmit most visible light but to reflect up to 90% of the infra-red radiation back into the cells.

The window 21 is fused to the top of the upper wafer 20' and encloses, within the cell 3, a pressurized atmosphere. Mixtures of halogen gases, and gases such as argon, krypton or xenon, that enable the well-known tungsten-halogen cycle are particularly advantageous. In this cycle, tungsten evaporates from the filament and combines with halogen at the internal surfaces in the cell to form an unstable gaseous tungsten-halogen compound. This compound is carried back to the filament where it separates into its original parts to repeat the cycle. The tungsten-halogen cycle enables filaments to be operated in a relatively high gas pressure giving an increased filament life; the cycle also reduces darkening of the envelope caused by tungsten deposition.

A second, outer silica window 23 is attached to the inner window 21 by means of silica spacers 24. The space 25 between the two windows 21 and 23 is evacuated to a high vacuum so as further to reduce heat loss from the upper surface of the assembly.

Figure 4:
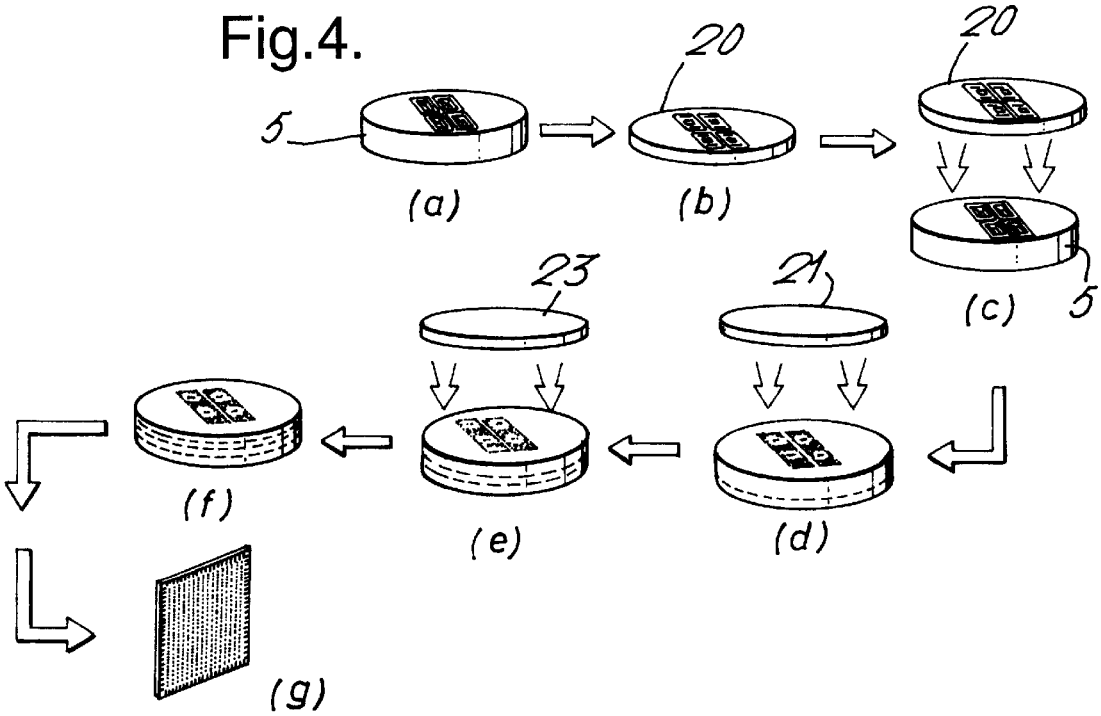
FIG. 4 illustrates stages in manufacture of the assembly.

With reference now to FIG. 4 there is illustrated a method of manufacture of the assembly 1. At (a), the upper surface of a lower silicon wafer 20 is isotropically etched along the crystal lattice to form the lower half of the cells and produce the walls sloping at the isotropic etch angle θ of 57.74 degrees. The underside of the wafer 20 is anodized with hydrogen fluoride to produce the microporous layer 6 with a density typically 20% that of the remainder of the wafer and a pore size between 1 and 10 nm. The next step, as shown at (b) is to etch the upper wafer 20', to form the upper half of the cells, and to deposit wiring and filament patterns. Tungsten bridges are deposited over supporting surfaces provided by sacrificial pads making electrical connection to adjacent conductors. The upper wafer 20' is isotropically etched along the crystal planes from the opposite side of the wafer to produce pyramid shape holes corresponding with the recesses 8 in the lower wafer. The walls of the hole are then aluminized to produce the reflective layer 15 before anisotropically etching to remove the sacrificial pads and leave the tungsten bridges extending unsupported across the bottom of each hole. The next step, as shown at (c), is to fusion bond the two wafers 20 and 20' together with the holes in the upper wafer aligned with the recesses in the lower wafer, to form the base structure 5. At (d), the lower silica window 21 is bonded to the base structure 5 in a halogen atmosphere, to encapsulate the filament 13. The outer silica window 23 is bonded to the lower window 21 under high vacuum, as shown at (e). Steps (f) and (g) show testing, thermal conditioning, trimming and forming the final terminations to produce the completed assembly.

In use, the display assembly 1 is connected to a conventional address unit 30 by which individual ones of the tungsten filaments 13 in each cell 3 can be addressed and a voltage applied across them. The address technique used can be any conventional technique, such as used, for example, in LCD matrix displays. The current flowing through a filament 13 is selected to raise its temperature typically to about 2900 K at which it incandesces and emits both visible and infra-red radiation. The visible radiation passes through the two silica windows 21 and 23, via the filter 22, either directly or after reflection from the metallized walls of the cell. The majority of the infra-red portion of the emission spectrum is contained within the cell and reflected back onto the filament 13, thus helping to maintain its temperature.

The five faceted reflecting surfaces of each cell, formed by its four walls and floor, ensure that almost the entire area of the front of the assembly is reflecting and bright, with very little dark space between the cells. The faceted surfaces also tend to scatter the light giving an even illumination and a wide viewing angle.

The assembly can be modified to produce a color display by means of three colored filters (red, green and blue) or four filters (red, green, blue and white) in front of adjacent cells. The address unit would then be arranged to drive appropriate ones of the cells so as to produce a full color display representation. Several layers of interconnections and local circuitry within the assembly itself may be needed as in conventional multi-color displays. The filters may be produced by spin coating a polymer film on the wafer and pixilating this by Excimer laser ablation. A black mask is then deposited (such as by printing) over some of the surface and the exposed pixels dyed with a fabric dye of suitable color. The mask is then removed by Excimer laser ablation and the process repeated for different colors until all the pixels have been colored. For grey-scale operation, the address unit 30 rapidly switches energization on and off to alter the intensity of illumination. This also has the effect of reducing the effective color temperature of those pixels concerned, giving a shift to the red end of the spectrum. The address unit 30 can compensate for this effect locally by, for example, increasing the illumination provided by the local blue pixels and reducing the illumination provided by the red pixels. Similarly, the brightness of the entire display can be changed by varying the switching rate of energization of the filaments across the entire display and by similarly correcting for a red shift (on dimming) or a blue shift (on brightening).

It will be appreciated that the assembly need not be a display but that it could instead be a lamp in which all the cells are energized to give an even light emission over the entire surface of the assembly. Such a lamp could be used, for example, to backlight a transparent display or instrument. The outer silica window of such a lamp could be translucent, frosted, patterned or modified in some other way to give a more diffuse light source. The interconnect layer in a lamp would be simplified by connecting all the filaments in parallel with the supply voltage, or in some series/parallel configuration, since there would be no need to be able to address individual filaments.

Assemblies of the present invention can have a very high thermal efficiency because of the reflective walls of the cells, the dichroic filter, the insulating layer of microporous material on the lower surface and the double-glazing provided by the two silica windows. The internal volume of each cell 3 is very small compared with a conventional tungsten-halogen bulb, being less than this by a factor of about 21000. This small internal volume considerably reduces the convection cooling effect of the filament, further improving the thermal efficiency. Another factor increasing the thermal efficiency of the assembly is the flat strip configuration of the filaments, which maximizes the surface area of the filament. A strip filament need not be supported along its length, in contrast to conventional coiled filaments. These mechanical supports have the disadvantage that they conduct heat away from the filament and reduce thermal efficiency. The small volume within the cells means that only a small volume of filling gas is required, enabling the use of more expensive filling gases with reduced conductivity, such as krypton or xenon.

The assembly can be very rugged because the small mass of the filaments reduces the inertial loading. Also, the small size of the filaments means that the natural frequency of the filaments will be above the range of normal environmental vibration frequencies. In coiled filaments, electromagnetic forces are produced between turns of the coils when current is initially turned on, causing most coils to fail at switch-on. The strip configuration of the filaments of the present invention avoids this problem. Hot spots caused by uneven coiling, which reduce the life of conventional coiled filaments, are also eliminated. The filaments of the present invention could be shaped along their length to produce an even temperature and reduce the cooling effect of heat conduction where the filaments are supported. In particular, the filaments may be given a smaller cross-sectional area in the regions where they are supported. This more even heat distribution helps make the redistribution of tungsten on the filament caused by the tungsten-halogen cycle more even along the filament, thereby prolonging the life of the filament.

Because the filaments have a very small thermal mass, their response time can be approximately five orders of magnitude shorter than conventional incandescent lamps. This enables a display according to the present invention to have a screen refresh rate of about 80 Hz.

The light output of the assembly depends on the filament area and temperature. Because these can both be high, the light output can also be high. In particular, the output of a 10×10 cm panel can be at least 12 times that of a conventional halogen headlamp, and considerably brighter than any other thin panel lamp or display. The high efficiency of the assembly means that it has a low power consumption and does not generate any radio frequency interference. Because the assembly only requires a low voltage drive, electrical insulation of the interconnections is simple and there is not need for protective components to prevent arcing damage if a filament should fail. The assembly does not require a start-up heater and is immune to external temperature variations over a wide range. Furthermore, there will be a negligible change in lumen output or color temperature of the assembly over its working life.

Although, at present, tungsten-halogen lamps are believed to be the most suitable filament lamps available, other forms of filament lamp may be suitable or become available in the future, such as, for example, lamps involving filaments of silicon, silica carbide or molybdenum.

What I claim is:

1. A light-emitting assembly comprising: a lower planar base member having an upper surface with a plurality of etched regions forming a plurality of recesses surrounded by walls, an upper planar transparent window; a seal between said window and said base member to define therebetween an array of light-emitting cells; a filling of a halogen gas in each said cell; and a filament in each cell provided by an uncoiled strip deposited on said upper surface of said base member prior to etching to extend continuously along a row of said cells, said strip being supported on said walls and being unsupported between said walls after etching of said recesses, such that energization of said strip causes unsupported regions of said strip to incandesce and emit light in a halogen cycle.

2. An assembly according to claim 1, wherein said filaments are approximately 10 $\mu$m wide and 5 $\mu$m thick.

3. An assembly according to claim 1, wherein said filament is of tungsten.

4. An assembly according to claim 1, wherein the gas filling said cells also includes krypton, xenon or argon.

5. An assembly according to claim 1, wherein said cells have side walls that slope outwardly towards an upper end of the cells.

6. An assembly according to claim 5, wherein said sloping walls are formed by etching isotropically along a crystal lattice of said base member.

7. An assembly according to claim 1 or 5, wherein said base member is substantially of silicon.

8. An assembly according to claim 1, wherein said cells are square.

9. An assembly according to claim 1, wherein said cells have a floor and side walls, and wherein said floor and side walls have a light-reflecting layer thereon.

10. An assembly according to claim 1, wherein said window has a filter arranged to transmit visible radiation and to reflect infra-red radiation back into said cells.

11. An assembly according to claim 1, wherein a lower surface of said base member is treated to make it microporous and reduce its thermal conductivity.

12. An assembly according to claim 1, including two transparent windows and a spacer spacing said windows one above the other.

13. An assembly according to claim 12, wherein the space between said two windows is evacuated.

14. An assembly according to claim 1, wherein said base member comprises an upper plate and a lower plate, and wherein said filament is supported at opposite ends on an upper surface of a lower plate.

15. An assembly according to claim 1, wherein the cross-section of each of said filaments varies along its length in such a way as to equalize heat distribution along the length of said filament.

16. An assembly according to claim 1, including an address unit connected to address individual ones of said cells.

17. An assembly according to claim 1, wherein said cells include different colored filters such that light from different ones of the cells are of different colors.

18. An assembly according to claim 17 including an address unit for controlling the brightness of light emitted from said cells, said address unit being arranged to vary the energization of cells of different colors to compensate for color shift on dimming or brightening.

19. The light-emitting assembly of claim 1 including; an address unit, connected to address individual ones of the cells so as to energize the respective filament and cause it to incandesce and thereby form a display representation on said assembly.

20. A light-emitting cell comprising: an incandescent filament; a support for opposite ends of the filament; and a window assembly extending above and sealed with said support to enclose the filament between the support and the window, the window assembly including two plates of transparent material separated from one another by an evacuated space, and a filter that transmits visible radiation but reflects infra-red radiation back into the cell.

* * * * *